US005538438A

United States Patent [19]

Orlando

[11] Patent Number: 5,538,438

[45] Date of Patent: Jul. 23, 1996

[54] RJ CONNECTOR AND COVER THEREFOR

[75] Inventor: Maurice V. Orlando, Greenhaven, Conn.

[73] Assignee: Ortronics, Inc., Pawcatuck, Conn.

[21] Appl. No.: 280,594

[22] Filed: Jul. 26, 1994

[51] Int. Cl.[6] ..... H01R 4/50

[52] U.S. Cl. ..... 439/344; 439/358; 439/676

[58] Field of Search ..... 439/344, 345, 439/350, 352, 353, 354, 357, 358, 676

[56] References Cited

U.S. PATENT DOCUMENTS

| | | | |
|---|---|---|---|
| 4,900,262 | 2/1990 | Matsuzaki | 439/354 |
| 5,334,044 | 8/1994 | Falossi et al. | 439/676 X |
| 5,395,268 | 3/1995 | Okada | 439/352 X |
| 5,435,744 | 7/1995 | Derstine et al. | 439/352 |

FOREIGN PATENT DOCUMENTS

| | | |
|---|---|---|
| 0477548 | 4/1992 | European Pat. Off. . |
| 0585808 | 3/1994 | European Pat. Off. . |
| 675506 | 9/1990 | Switzerland . |

*Primary Examiner*—Khiem Nguyen
*Attorney, Agent, or Firm*—St. Onge Steward Johnston & Reens

[57] ABSTRACT

Snag-free assembly of a communications system utilizing RJ-type connectors having locking clip is enabled by the provision of a protective cover. The cover is preferably molded in a single piece to wrap around the RJ-type connector at one of a patching cable. In addition to the feature that the locking clip is protected against snags when it is drawn through openings in wire management systems, the locking clip protector also provides a convenient lever to depress the clip and facilitate operation with recessed sockets and close spaces. The cover includes slots for holding identifying labels and is preferably color coded and protected against removal and reuse. Also, the cover provides strain relief at the juncture of the cable and the modular plug.

20 Claims, 4 Drawing Sheets

FIG. 3
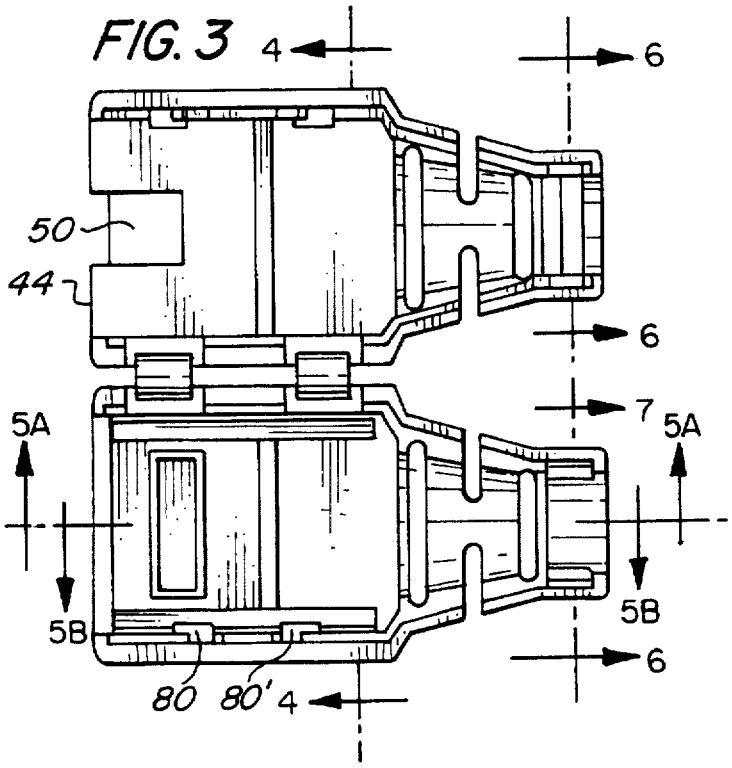
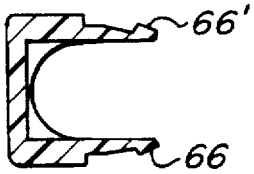
FIG. 6
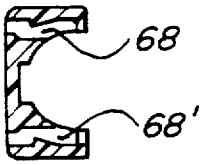
FIG. 7
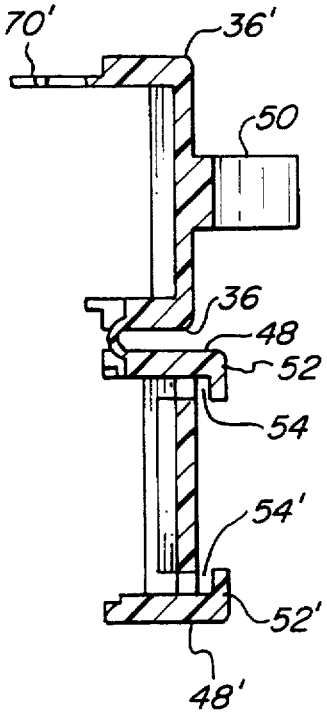
FIG. 4
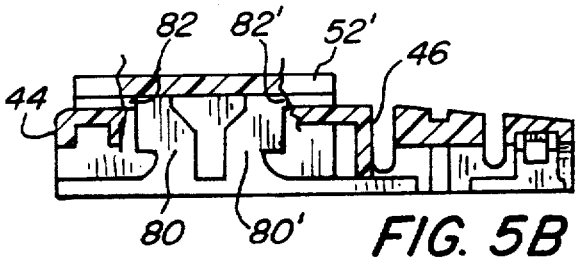
FIG. 5B
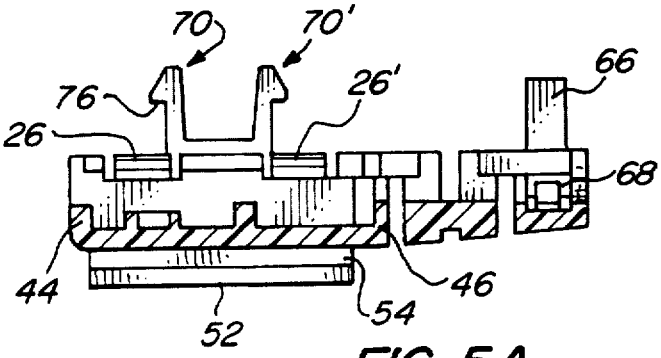
FIG. 5A

RJ CONNECTOR AND COVER THEREFOR

TECHNICAL FIELD

The invention relates to improvements in patch cabling and systems employing it; and, more particularly to a cover for modular plug which enables more rapid assembly and modification of components in wire management systems.

Communications technology (including data, video and voice processing and transmission) is placing ever-increasing demands on wire management systems and the personnel responsible for their installation and maintenance. The associated manual tasks are accelerating in terms not only of number of units installed but also the frequent need to upgrade and add to the capabilities of the systems.

Efficient wire management requires convenient access to equipment and rapid, accurate connection and disconnection—often of several individual services (e.g., electronic data processing, telecommunications, and video). Connections are typically made by the use of patch cables to interconnect the various service components, held in a communication and wire management rack. The patch cables have modular plugs which mate with modular jacks on the components. The plugs and jacks conform to Universal Service Ordering Codes (USOC) with various RJ (i.e., registered jack) code numbers. Plugs meeting the RJ 45 criteria are widely used in this environment.

One drawback of RJ 45 and other connectors in use on preterminated cables today is that they have a locking clip which, while very helpful in obtaining a secure mating of conductors and providing a positive indication of it, includes a protruding tab which tends to snag on through-holes and cable hangers associated with wire management racks. Also, the clips are sometimes difficult to depress when the plugs are inserted in jacks which might be recessed or at difficult-to-reach positions.

BACKGROUND ART

The art has provided a number of different types of covers for RJ-coded and other connectors. Among these are flex covers which provide a stress distribution between the plug and the associated cable. Most of these are designed for being molded on during the manufacturing process and cannot be employed to retrofit existing cabling. Others have been designed to simply snap around the plug and cable. Some of both types have been color coded to facilitate rapid connect and disconnect while assuring that elements of one system (e.g., video) is not connected to those of another different system (e.g., electronic data processing). Also, some covers have been provided to provide distinctly-coded keys and keyways to prevent undesirable connections. However, despite the variety of plug connectors, none is known to include a feature which prevents the associated locking clip from snagging on through-holes, cable hangers, and other wire management components.

DISCLOSURE OF THE INVENTION

It is an object of the invention to provide an improved RJ-type connector plug and patch cord containing it which include a feature to alleviate the problem of snagging on wire management components.

It is another object of the invention to provide a cover for an RJ-type connector plug which includes an anti-snag feature.

It is a further object of the invention to provide an improved method for field assembling a communications system which permits drawing preterminated cabling through through-holes and cable hangers without snagging.

It is a more specific object of one embodiment of the invention to provide an improved RJ-type modular connector plug cover that can be attached to existing cabling in the field to facilitate drawing preterminated cabling through through-holes and cable hangers without snagging.

It is yet another object of the invention to provide a cover for an RJ-type modular connector plug, an improved RJ-type connector plug, and patch cord containing it which include a feature to alleviate the problem of snagging on wire management components and thereby facilitate field installation of preterminated cabling.

It is another object of the invention to provide a cover for a modular plug connector which can be snapped over existing patch cables to provide cable strain relief and an anti-snag feature.

It is an even more specific object of the invention to provide a cover for a modular plug connector of the RJ-type which can be snapped over existing patch cables to provide cable strain relief and an anti-snag feature, and which further has a feature which prevents it from being unassembled and then affixed to a different cable.

It is another object of one preferred embodiment of the invention to provide a cover for an RJ-type modular connector plug which includes an anti-snag feature and provides means to hold an identification strip for component identification.

These and other objects are achieved by the present invention which provides a new cover for an RJ-type modular connector, a connector improved by the cover, a preterminated cable including a covered RJ-type connector, and an improved method for assembling a communications system using the cover.

The cover according to the invention comprises:

- a guard section having an interior surface, an exterior surface, a front edge, a rear edge, and two side edges extending from the front edge to the rear edge;
- a second section complimentary with the guard section having an interior surface, an exterior surface, a front edge, a rear edge, and two side edges extending between the front edge and the rear edge; and
- a locking clip guard attached to the exterior surface of the guard section.

BRIEF DESCRIPTION OF THE DRAWINGS

The invention will be better understood and its advantages will be better appreciated from the following detailed description, especially when read in light of the accompanying drawings, wherein:

FIG. 3 is a top plan view of the cover of the invention in its flat open configuration;

FIG. 4 is a cross-sectional view taken along line 4—4 in FIG. 3;

FIG. 5A is a cross-sectional view taken along line 5A—5A in FIG. 3;

FIG. 5B is a cross-sectional view taken along line 5B—5B in FIG. 3

FIG. 6 is a cross-sectional view taken along line 6—6 in FIG. 3;

FIG. 7 is a cross-sectional view taken along line 7—7 in FIG. 3;

INDUSTRIAL APPLICABILITY

Figures 1A, 1B:
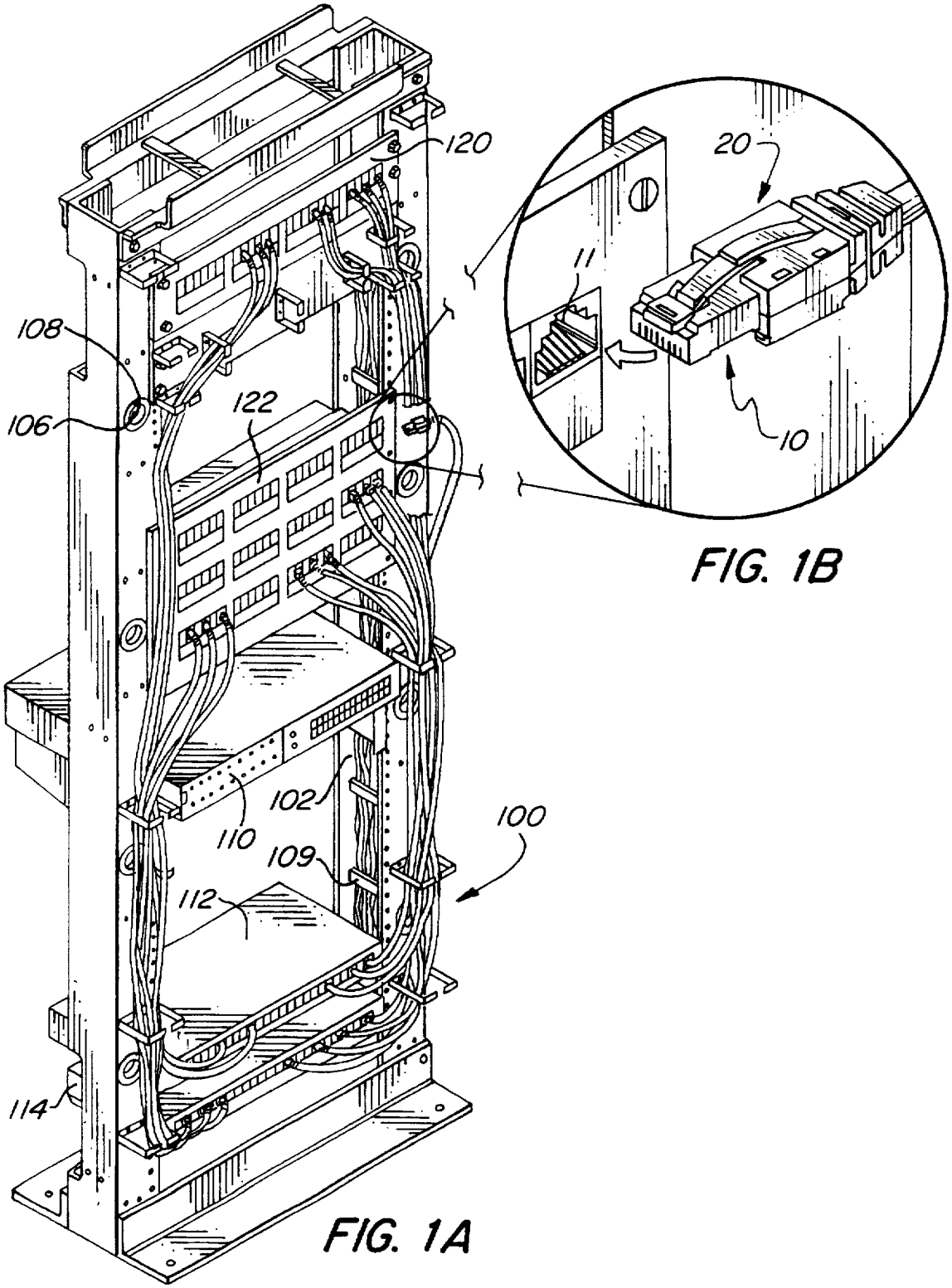
FIG. 1A is a perspective view of a typical communications equipment and wire management rack showing how cables are fed through through-holes, cable hangers, and tubular sections in the rack itself.
FIG. 1B is an enlarged perspective view of the area circled and projected from FIG. 1A showing an RJ-type modular plug which is improved with the snag-resistant cover of the invention, the plug shown ready for insertion into a mating modular socket.

The improvements of the invention have preferred application to the field of communications connections employing modular connectors of the RJ-type, typically in the environment of an equipment and wire management rack of the type shown as 100 in FIG. 1A. The term "RJ-type connector" is defined herein (in connection with FIG. 2) to include, specifically, the various modular communication connector plugs assigned RJ numbers according to the USOC which have a plastic connector holder 12, a plurality of contact wires 14, a cable 16 including a plurality of wires attached to the contact wires, and a locking clip 18. The drawings are intended to depict a plug of the RJ-45 type, but the invention is not limited to such.

Snag-free assembly of a communications system utilizing RJ-type connectors having locking clip is enabled by the provision of a protective cover. The cover is preferably molded in a single piece to wrap around the RJ-type connector at one of a patching cable. In addition to the feature that the locking clip is protected against snags when it is drawn through openings in wire management systems, the locking clip protector also provides a convenient lever to depress the clip and facilitate operation with recessed sockets and close spaces. The cover includes slots for holding identifying labels and is preferably color coded and protected against removal and reuse. Also, the cover provides strain relief at the juncture of the cable and the modular plug. These features will now be explained in relation to the drawings.

Rack 100 is shown in FIG. 1A to hold a plurality of pieces of communications equipment 110, 112 and 114. It also holds a number of connection panels 120 and 122. Cabling is shown running to these components through various wire management devices including the channels 102 formed in the rack, cable hangers 104, through-holes 106 (shown in the drawing to have protective grommets 108), and clips 109 for stabilizing cables within channels 102. The cables are known in the art as patch cables and are typically preterminated with modular plugs at each end. This type of installation is for illustration only, as there are a variety of different wire management systems and components.

Figure 2:
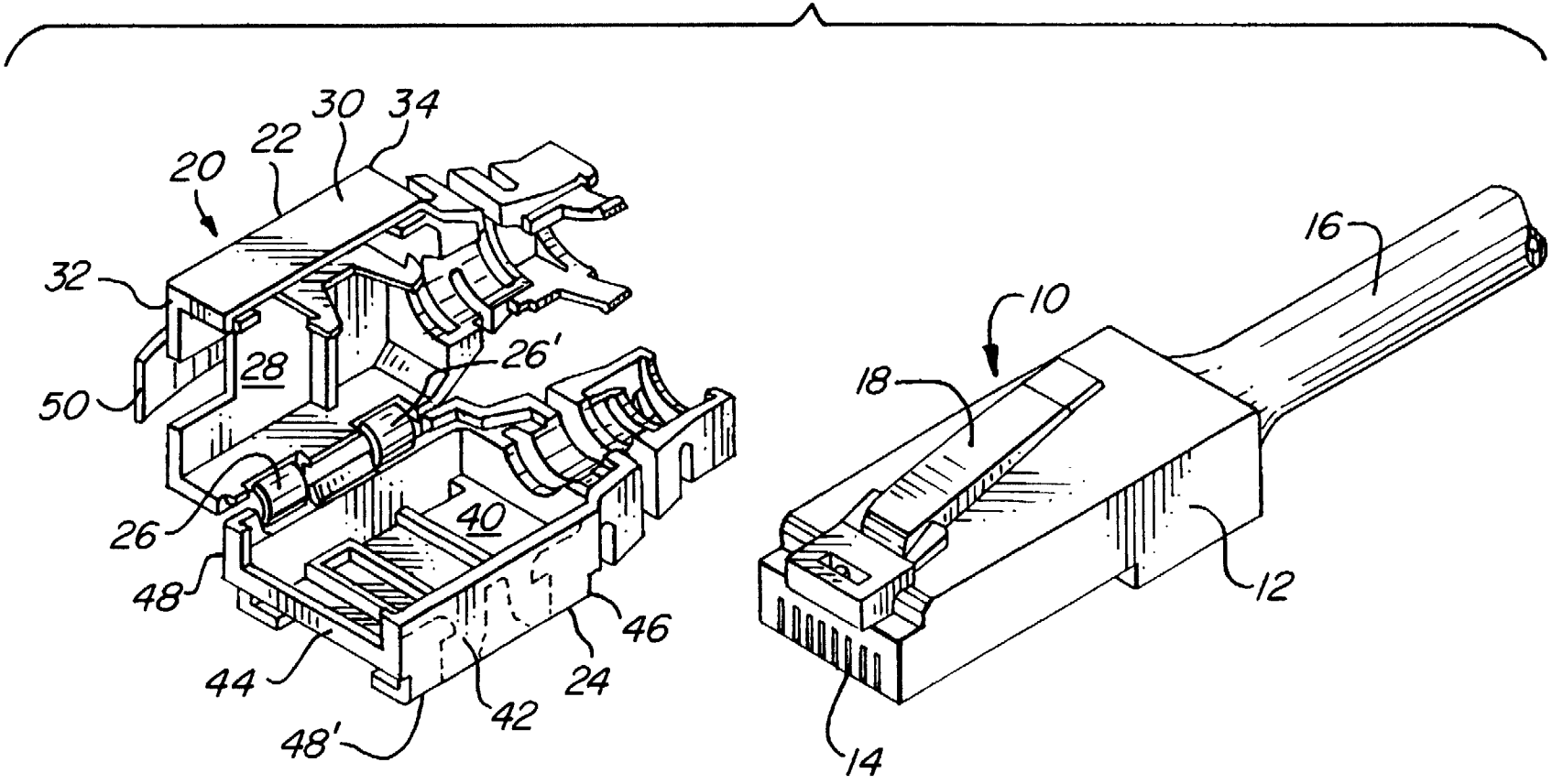
FIG. 2 is an exploded perspective view showing the relationship of the cover and its major components to the modular plug.

The importance of the invention can be easily understood by noting the unprotected locking clip 18 shown in FIG. 2 prior to closing the cover 20 over the modular plug 10. One end of a preterminated patch cable improved by the protective cover 20 of the invention is shown in FIG. 1B ready for insertion into modular socket 11.

As can be seen in FIGS. 2 and 3, especially, the cover 20 of the invention for an RJ-type modular connector, is comprised of two principal sections: a guard section 22 and a second section 24. The cover 20 is preferably molded in one piece of a material such as polyethylene, preferably of medium to high density for a suitable balance of strength and flexibility. The material of construction is also preferably colored to provide a means for coding the covers to identify various system components that they are connecting.

The cover 20 is shown to have the two sections joined by a pair of integrally molded hinges 26 and 26'. The guard section 22 has an interior surface 28, an exterior surface 30, a front edge 32, a rear edge 34, and two side edges 36 and 36' extending from the front edge 32 to the rear edge 34. The second section 24 is complimentary with the guard section 22 and has an interior surface 40, an exterior surface 42, a front edge 44, a rear edge 46, and two side edges 48 and 48' extending between the front edge and the rear edge.

A locking clip guard 50 is attached to the exterior surface 30 of the guard section 22. The locking clip guard 50 has a gently rounded configuration to permit it to easily slide over the locking clip. Guard 50 is shown to extend from the exterior surface 30 of the guard section 22, from a location between the front edge 32 and the rear edge 34, toward the front edge. The top wall of guard section 22, underneath the guard 50, is cut away as necessary to provide freedom of movement of the locking clip 18 on the plug 10.

Figure 8:
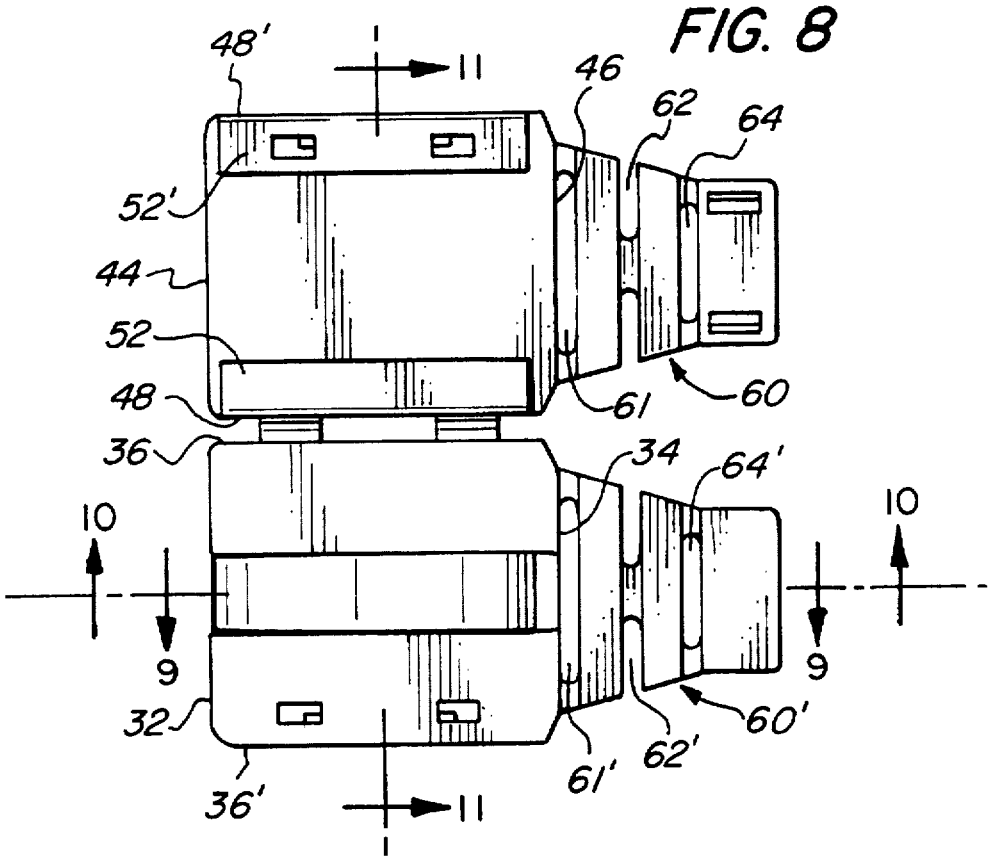
FIG. 8 is a bottom plan view of the cover of the invention in its flat open configuration.
Figure 9:
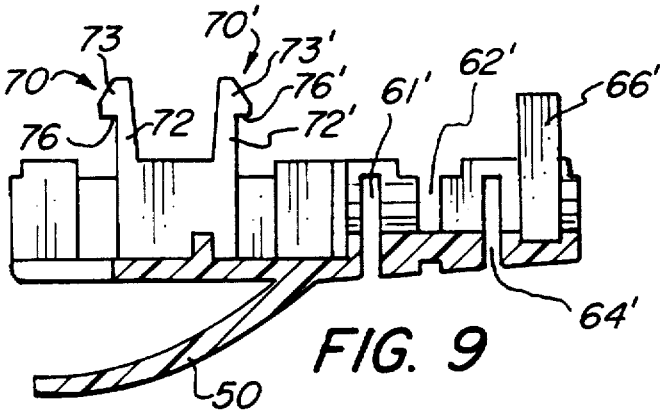
FIG. 9 is a cross-sectional view taken along line 9—9 in FIG. 8.
Figure 10:
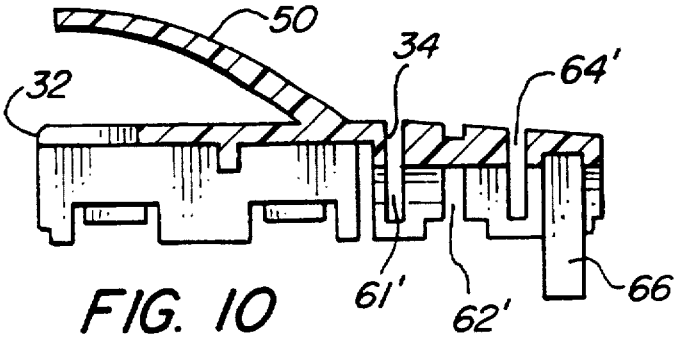
FIG. 10 is a cross-sectional view taken along line 10—10 in FIG. 8.
Figure 11:
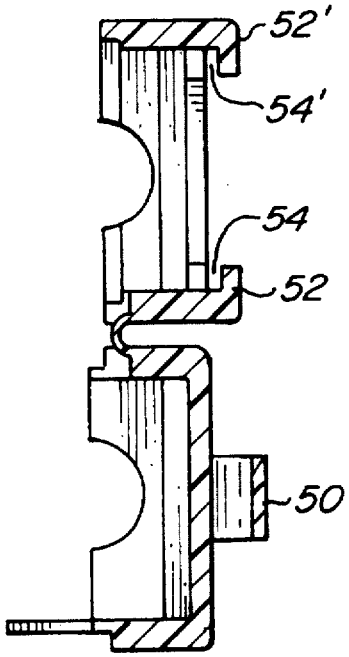
FIG. 11 is a cross-sectional view taken along line 11—11 in FIG. 8.

The second section includes a pair of channels opposed, brackets 52 and 52' (best seen in FIGS. 8 and 11) which form opposed slots 54 and 54' configured to hold an identifying media (typically a paper or paperboard label, not shown) against the exterior surface of the second section.

The protective cover 20 of the invention further includes tapered, flexible, mating sections 60 and 60' adjacent the rear edges of both the guard and second sections to, when mated, form a flexible cable strain-relief section. The mating sections of the strain relief sections have cut-away portions (e.g., 61, 62 and 64) molded in to enable greater flex. The strain relief sections have mail clip members 66 and 66' on one section and female engaging members 68 and 68' on the other section.

The cover 20 further preferably includes male clip elements 70 and 70' extending from the interior surface of one section (here shown extending from the interior of the guard section) and mating female element in the other section. Each male clip element, e.g. 70, is shown to include an elongated shaft 72 and a tip 73 having a point 74 at its end and a stepped-in section 76 spaced from the point. Mating female elements 80 and 80' are each shown to include a slot configured to receive the shaft 72 and tip 73 of a male member and a stepped portion 82 to engage the stepped-in portion 76 of a male clip element 70. The stepped-in section 70 of the male clip element is preferably constructed of a material and is of a dimension to tightly grip the tip in the slot of the female element and to deform upon separation of the male clip element from the female element.

The cover, improved connector and improved cabling of the invention enable the rapid assembly of communication systems with the time-consuming problems associated with snags of locking clips on the various holes or obstructions encountered in equipment and wire management systems. They do so in a manner which enables coding and cable identification, and with protection of the plug-cable connection by providing stress relief. They also permit locking clips to be operated with greater facility in close spaces.

The above description is for the purpose of teaching the person of ordinary skill in the art how to practice the invention, and it is not intended to detail all of those obvious modifications and variations of it which will become apparent to the skilled worker upon reading the description. It is intended, however, that all such obvious modifications and variations be included within the scope of the invention which is defined by the following claims. The claims are meant to cover the claimed elements and steps in any arrangement or sequence which is effective to meet the objectives there intended, unless the context specifically indicates the contrary.

I claim:

1. A cover for an RJ-type modular connector; said RJ-type modular connector comprising a rectangular plug body having electrical connectors exposed on one side and having a locking clip attached to the opposite side, said locking clip having a free end extending outwardly from the plug body and away from said exposed electrical connectors; said cover having two relating sections joined by an integrally molded hinge means and comprising a guard section having an interior surface, an exterior surface, a front edge, a rear edge, and two side edges extending from the front edge to the rear edge; said guard section being sized and shaped to conform to at least a portion of the side of the plug body having the locking clip;

a second section complimentary with the guard section having an interior surface, an exterior surface, a front edge, a rear edge, and two side edges extending between the front edge and the rear edge; said second section being sized and shaped to conform to at least a portion the side of the plug body having the exposed electrical connectors;

a locking clip guard attached to and outwardly extending from the exterior surface of the guard section; said locking clip guard being aligned to extend over at least said free end of the locking clip when said cover is attached to the RJ-type modular connector.

2. A cover according to claim 1 wherein the locking clip guard extends from the exterior surface of the guard section, from a location between the front and rear edges to the front edge.

3. A cover according to claim 1 wherein the second section includes a pair of channels having opposed slots configured to hold an identifying media against the exterior surface of the second section.

4. A cover according to claim 1 which further includes tapered, flexible, mating sections adjacent the rear edges of both the guard and second sections to, when mated, form a flexible cable strain-relief section.

5. A cover according to claim 1 which further includes male clip element extending from the interior surface of one section and mating female element in the other section.

6. A cover according to claim 5 wherein: the male clip element includes an elongated shaft and a tip having a point at its end and a stepped-in section spaced from the point, and the female element includes a slot configured to receive the shaft and tip and a stepped portion to engage the stepped-in portion of the male clip element, said stepped-in section of the male clip element being constructed of a material and of a dimension to tightly grip the tip in the slot of the female element and to deform upon separation of the male clip element from the female element.

7. A cover for an RJ-type modular connector; said RJ-type modular connector comprising a rectangular plug body having electrical connectors exposed on one side and having a locking clip attached to the opposite side, said locking clip having a free end extending outwardly from the plug body and away from said exposed electrical connectors; said cover having two mating sections joined by an integrally molded hinge means and comprising a guard section having an interior surface, an exterior surface, a front edge, a rear edge, and two side edges extending from the front edge to the rear edge; said guard section being sized and shaped to conform to at least a portion of the side of the plug body having the locking clip;

a second section complimentary with the guard section having an interior surface, an exterior surface, a front edge, a rear edge, and two side edges extending between the front edge and the rear edge and further includes a pair of channels having opposed slots configured to hold an identifying media against the exterior surface of the second section; said second section being sized and shaped to conform to at least a portion of the side of the plug body having the exposed electrical connectors;

a locking clip guard attached to and outwardly extending from the exterior surface of the guard section and extending from the exterior surface of the guard, from a location between the front and rear edges of the second section; said locking clip guard being aligned to extend over at least a free end of the locking clip when said cover is attached to the RJ-type modular connector;

at least one male clip element extending from the interior surface of one section and a mating female element in the other section, wherein the male clip element includes an elongated shaft and a tip having a point at its end and a stepped-in section spaced from the point, and the female element includes a slot configured to receive the shaft and tip and a stepped portion to engage the stepped-in portion of the male clip element, said stepped-in section of the male clip element being constructed of a material and of a dimension to tightly grip the tip in the slot of the female element and to deform upon separation of the male clip element from the female element; and tapered, flexible, mating sections adjacent the rear edges of both the guard and second sections to, when mated, form a flexible cable strain-relief section.

8. A snag-proof, modular electrical connector comprising:

(a) an RJ-type modular plug including a plug body with electrical contacts exposed at one end, a cable extending from an end of the plug body opposite to the electrical contacts, and a locking clip attached to the plug body at the end of the plug body with the electrical contacts and having a free end extending outwardly and toward the end of the plug body from which the cable extends; and (b) an outer cover extending around at least a portion of the plug body, said cover having two mating sections joined by an integrally molded hinge means and including a guard section having an interior surface, an exterior surface, a front edge, a rear edge, and two side edges extending from the front edge to the rear edge;

a second section complimentary with the guard section having an interior surface, an exterior surface, a front edge, a rear edge, and two side edges extending between the front edge and the rear edge; and a locking clip guard attached to the exterior surface of the guard section, said locking clip guard extending over at least the free end of the locking clip.

9. A snag-proof, modular electrical connector according to claim 8 wherein the locking clip guard includes a free end which extends from the exterior surface of the guard section, from a location between the front and rear edges to the front edge.

10. A snag-proof, modular electrical connector according to claim 8 wherein second section of the cover further includes a pair of channels having opposed slots configured to hold an identifying media against the exterior surface of the second section.

11. A snag-proof, modular electrical connector according to claim 8 wherein the cover further includes tapered, flexible, mating sections adjacent the rear edges of both the guard and second sections to, when mated, form a flexible cable strain-relief section.

12. A snag-proof, modular electrical connector according to claim 8 wherein the cover further includes male clip element extending from the interior surface of one section and mating female element in the other section.

13. A snag-proof, modular electrical connector according to claim 12 wherein: the male clip element included in the cover includes an elongated shaft and a tip having a point at its end and a stepped-in section spaced from the point, and the female element includes a slot configured to receive the shaft and tip and a stepped portion to engage the stepped-in portion of the male clip element, said stepped-in section of the male clip element being constructed of a material and of a dimension to tightly grip the tip in the slot of the female element and to deform upon separation of the male clip element from the female element.

14. A preterminated patch cable comprising:

(a) a cable comprised of a plurality of conductors enclosed within an outer sheath;

(b) an RJ-type modular plug connected to at least one end of said cable, said plug including a plug body with electrical contacts exposed at one end, said cable extending from an end of the plug body opposite to the electrical contacts, and a locking clip attached to the plug body at the end of the plug body with the electrical contacts and having a free end extending outwardly and toward the end of the plug body from which the cable extends;

(c) an outer cover extending around at least a portion of the plug body, said cover having two mating sections joined by an integrally molded hinge means and including a guard section having an interior surface, an exterior surface, a front edge, a rear edge, and two side edges extending from the front edge to the rear edge;

a second section complimentary with the guard section having an interior surface, an exterior surface, a front edge, a rear edge, and two side edges extending between the front edge and the rear edge; and a locking clip guard attached to the exterior surface of the second section, said locking clip guard extending over at least the free end of the locking clip.

15. A preterminated patch cable according to claim 14 wherein the locking clip guard includes a free end which extends from the exterior surface of the guard section, from a location between the front and rear edges to the front edge.

16. A preterminated patch cable according to claim 14 wherein second section of the cover further includes a pair of channels having opposed slots configured to hold an identifying media against the exterior surface of the second section.

17. A preterminated patch cable according to claim 14 wherein the cover further includes tapered, flexible, mating sections adjacent the rear edges of both the guard and second sections to, when mated, form a flexible cable strain-relief section.

18. A preterminated patch cable according to claim 14 wherein the cover further includes male clip element extending from the interior surface of one section and mating female element in the other section.

19. A preterminated patch cable according to claim 18 wherein: the male clip element included in the cover includes an elongated shaft and a tip having a point at its end and a stepped-in section spaced from the point, and the female element includes a slot configured to receive the shaft and tip and a stepped portion to engage the stepped-in portion of the male clip element, said stepped-in section of the male clip element being constructed of a material and of a dimension to tightly grip the tip in the slot of the female element and to deform upon separation of the male clip element from the female element.

20. An improved method for assembling a communications system, comprising:

attaching a cover as defined in claim 1 for an RJ-type modular connector to a preterminated end of a communications patch cable to protect the locking clip; and pulling the end of the cable having the connector through an opening in a wire management support.

* * * * *